US006098698A

United States Patent [19]

King-Darr

[11] Patent Number: 6,098,698

[45] Date of Patent: Aug. 8, 2000

[54] GARAGE DOOR OPENING SCREEN ENCLOSURE

[76] Inventor: Carol L. King-Darr, 11 Sunrise Cir., Connellsville, Pa. 15425

[21] Appl. No.: 09/209,610

[22] Filed: Dec. 11, 1998

[51] Int. Cl.[7] ..... A47G 5/02; E06B 9/56

[52] U.S. Cl. ..... 160/290.1; 160/23.1; 160/310

[58] Field of Search ..... 160/90, 98, 133, 160/267.1, 273.1, 290.1, 113, 310, 23.1; 49/199, 200, 478.1

[56] References Cited

U.S. PATENT DOCUMENTS

| | | | |
|---|---|---|---|
| 3,421,568 | 1/1969 | Youngs | 160/310 |
| 3,563,594 | 2/1971 | London | 160/368 X |
| 4,478,268 | 10/1984 | Palmer | 160/310 |
| 4,497,515 | 2/1985 | Appelson | 160/290.1 X |
| 4,846,241 | 7/1989 | Chomka et al. | 160/290.1 X |
| 4,991,887 | 2/1991 | Hahn | 292/DIG. 36 X |
| 5,123,474 | 6/1992 | Smith | 160/310 |
| 5,203,392 | 4/1993 | Shea | 160/310 X |

*Primary Examiner*—Daniel P. Stodola
*Assistant Examiner*—Hugh B. Thompson

[57] ABSTRACT

A garage door opening screened enclosure for preventing debris and pests from entering a garage through an open garage door opening. The garage door opening screened enclosure includes a garage structure with a garage door opening. A housing is coupled to the exterior of the garage structure and is positioned above the top of the garage door opening. The housing has an elongate lower slot extending along the top of the garage door opening. An elongate rod is rotatably mounted in the housing to permit free rotation about an axis of the rod. The top edge of a screen enclosure is coupled to the rod so that the screen enclosure downwardly depends from the rod through the lower slot of the housing. A pair of elongate guide rails are coupled to the exterior of the garage structure on either side of the garage door opening. Each of the guide rails has an elongate guide channel extending therealong. One side edge of the screen enclosure is slidably inserted into the guide channel of the one guide rail and the other side edge of the screen enclosure is slidably inserted into the guide channel of the other guide rail.

8 Claims, 3 Drawing Sheets

GARAGE DOOR OPENING SCREEN ENCLOSURE

BACKGROUND OF THE INVENTION

1. Field of the Invention

The present invention relates to garage door opening screened enclosures and more particularly pertains to a new garage door opening screened enclosure for preventing debris and pests from entering a garage through an open garage door opening.

2. Description of the Prior Art

The use of garage door opening screened enclosures is known in the prior art. More specifically, garage door opening screened enclosures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,673,019; 5,050,660; 3021,896; 4,231,412; U.S. Pat. No. Des. 374,487; and U.S. Pat. No. 3,103,967.

While these devices fulfill their respective, particular objectives and requirements, the aforementioned patents do not disclose a new garage door opening screened enclosure. The inventive device includes a garage structure with a garage door opening. A housing is coupled to the exterior of the garage structure and is positioned above the top of the garage door opening. The housing has an elongate lower slot extending along the top of the garage door opening. An elongate rod is rotatably mounted in the housing to permit free rotation about an axis of the rod. The top edge of a screen enclosure is coupled to the rod so that the screen enclosure downwardly depends from the rod through the lower slot of the housing. A pair of elongate guide rails are coupled to the exterior of the garage structure on either side of the garage door opening. Each of the guide rails has an elongate guide channel extending therealong. One side edge of the screen enclosure is slidably inserted into the guide channel of the one guide rail and the other side edge of the screen enclosure is slidably inserted into the guide channel of the other guide rail.

In these respects, the garage door opening screened enclosure according to the present invention substantially departs from the conventional concepts and designs of the prior art, and in so doing provides an apparatus primarily developed for the purpose of preventing debris and pests from entering a garage through an open garage door opening.

SUMMARY OF THE INVENTION

In view of the foregoing disadvantages inherent in the known types of garage door opening screened enclosures now present in the prior art, the present invention provides a new garage door opening screened enclosure construction wherein the same can be utilized for preventing debris and pests from entering a garage through an open garage door opening.

The general purpose of the present invention, which will be described subsequently in greater detail, is to provide a new garage door opening screened enclosure apparatus and method which has many of the advantages of the garage door opening screened enclosures mentioned heretofore and many novel features that result in a new garage door opening screened enclosure which is not anticipated, rendered obvious, suggested, or even implied by any of the prior art garage door opening screened enclosures, either alone or in any combination thereof.

To attain this, the present invention generally comprises a garage structure with a garage door opening. A housing is coupled to the exterior of the garage structure and is positioned above the top of the garage door opening. The housing has an elongate lower slot extending along the top of the garage door opening. An elongate rod is rotatably mounted in the housing to permit free rotation about an axis of the rod. The top edge of a screen enclosure is coupled to the rod so that the screen enclosure downwardly depends from the rod through the lower slot of the housing. A pair of elongate guide rails are coupled to the exterior of the garage structure on either side of the garage door opening. Each of the guide rails has an elongate guide channel extending therealong. One side edge of the screen enclosure is slidably inserted into the guide channel of the one guide rail and the other side edge of the screen enclosure is slidably inserted into the guide channel of the other guide rail.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new garage door opening screened enclosure apparatus and method which has many of the advantages of the garage door opening screened enclosures mentioned heretofore and many novel features that result in a new garage door opening screened enclosure which is not anticipated, rendered obvious, suggested, or even implied by any of the prior art garage door opening screened enclosures, either alone or in any combination thereof.

It is another object of the present invention to provide a new garage door opening screened enclosure which may be easily and efficiently manufactured and marketed.

It is a further object of the present invention to provide a new garage door opening screened enclosure which is of a durable and reliable construction.

An even further object of the present invention is to provide a new garage door opening screened enclosure which is susceptible of a low cost of manufacture with regard to both materials and labor, and which accordingly is then susceptible of low prices of sale to the consuming public, thereby making such garage door opening screened enclosure economically available to the buying public.

Still yet another object of the present invention is to provide a new garage door opening screened enclosure which provides in the apparatuses and methods of the prior art some of the advantages thereof, while simultaneously overcoming some of the disadvantages normally associated therewith.

Still another object of the present invention is to provide a new garage door opening screened enclosure for preventing debris and pests from entering a garage through an open garage door opening.

Yet another object of the present invention is to provide a new garage door opening screened enclosure which includes a garage structure with a garage door opening. A housing is coupled to the exterior of the garage structure and is positioned above the top of the garage door opening. The housing has an elongate lower slot extending along the top of the garage door opening. An elongate rod is rotatably mounted in the housing to permit free rotation about an axis of the rod. The top edge of a screen enclosure is coupled to the rod so that the screen enclosure downwardly depends from the rod through the lower slot of the housing. A pair of elongate guide rails are coupled to the exterior of the garage structure on either side of the garage door opening. Each of the guide rails has an elongate guide channel extending therealong. One side edge of the screen enclosure is slidably inserted into the guide channel of the one guide rail and the other side edge of the screen enclosure is slidably inserted into the guide channel of the other guide rail.

Still yet another object of the present invention is to provide a new garage door opening screened enclosure that is retractable to permit passage through the garage door opening.

Even still another object of the present invention is to provide a new garage door opening screened enclosure that is mounted to the exterior of the garage structure so that the garage door may be lowered behind the screened enclosure without hindrance from the screen enclosure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
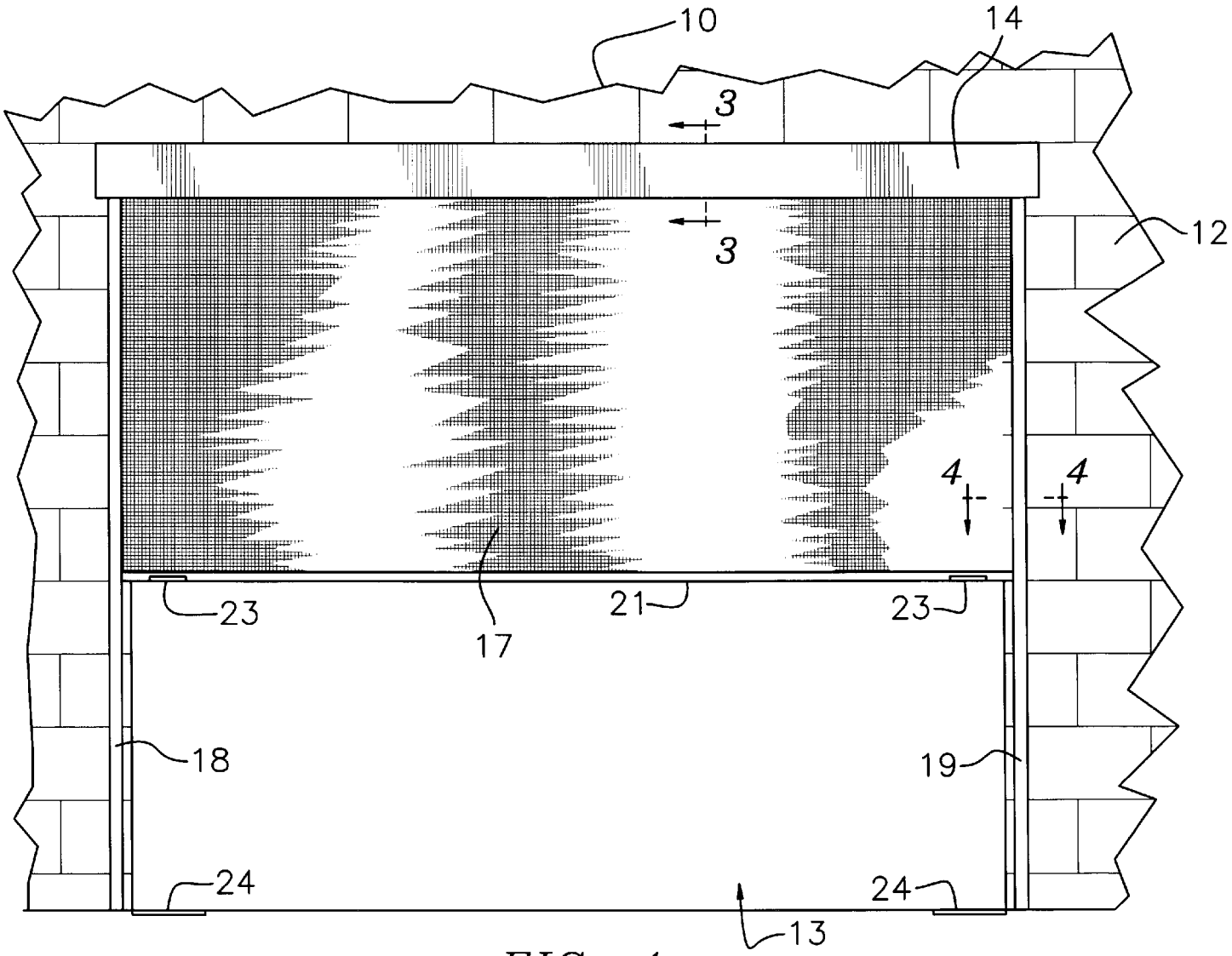
FIG. 1 is a schematic front exterior view of a new garage door opening screened enclosure according to the present invention.
Figure 2:
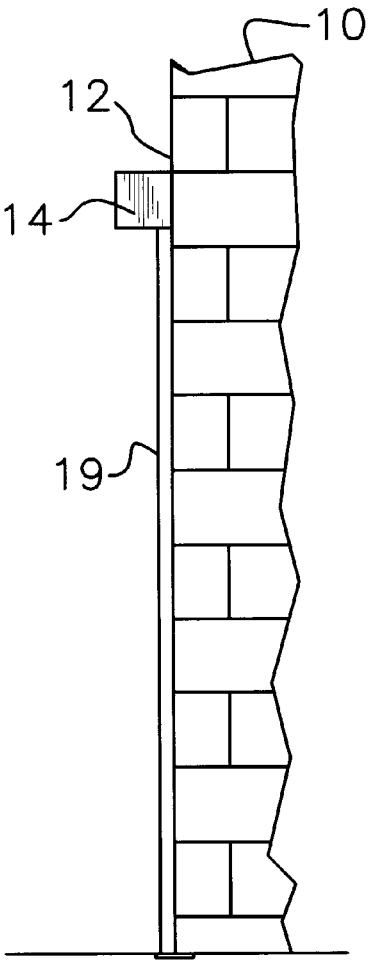
FIG. 2 is a schematic side view of the present invention.
Figure 3:
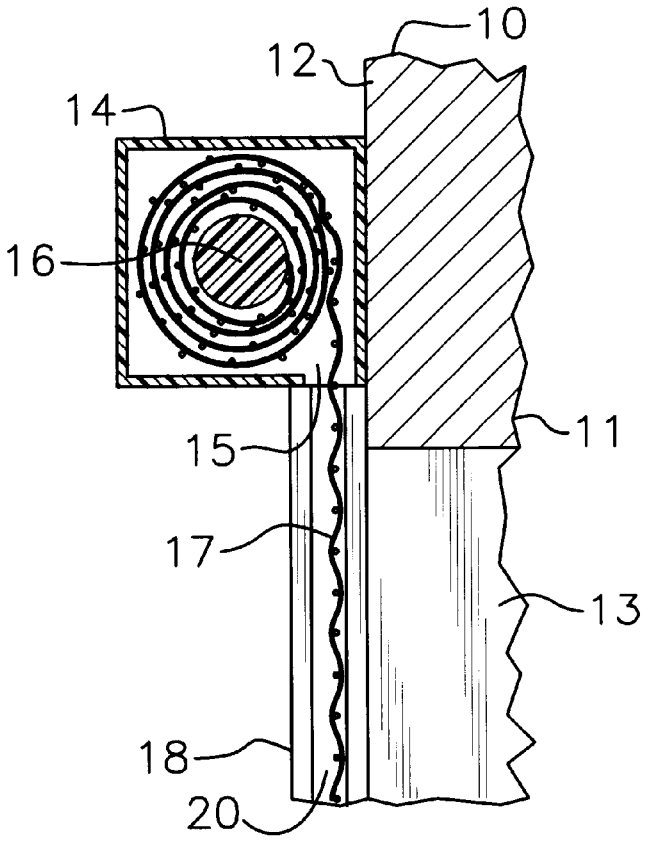
FIG. 3 is a schematic cross sectional view of the housing taken from line 3—3 of FIG. 1.

With reference now to the drawings, and in particular to FIGS. 1 through 4 thereof, a new garage door opening screened enclosure embodying the principles and concepts of the present invention will be described.

As best illustrated in FIGS. 1 through 5, the invention generally comprises a garage structure with a garage door opening. A housing is coupled to the exterior of the garage structure and is positioned above the top of the garage door opening. The housing has an elongate lower slot extending along the top of the garage door opening. An elongate rod is rotatably mounted in the housing to permit free rotation about an axis of the rod. The top edge of a screen enclosure is coupled to the rod so that the screen enclosure downwardly depends from the rod through the lower slot of the housing. A pair of elongate guide rails are coupled to the exterior of the garage structure on either side of the garage door opening. Each of the guide rails has an elongate guide channel extending therealong. One side edge of the screen enclosure is slidably inserted into the guide channel of the one guide rail and the other side edge of the screen enclosure is slidably inserted into the guide channel of the other guide rail.

In closer detail, the garage structure 10 has an interior 11, an exterior 12, and a generally rectangular garage door opening 13 between the interior and the exterior of the garage structure. Typically, a garage door is mounted to the interior of the garage structure to retractably close the garage door opening. The garage door opening of the garage structure has an outer perimeter comprising generally horizontal top and bottom, and a pair of generally vertical sides extending between the top and bottom of the garage door opening. The top and bottom of the garage door opening are preferably extended substantially parallel to one another and the sides of the garage door opening are preferably extended substantially parallel to one another and substantially perpendicular to the top and bottom of the garage door opening.

A generally rectangular housing 14 is coupled to the exterior of the garage structure and is positioned above the top of the garage door opening. The housing has an elongate lower slot 15 extending along the top of the garage door opening. The lower slot of the housing has a pair of opposite ends with one of the ends of the lower slot positioned adjacent one of the sides of the garage and the other end of the lower slot positioned adjacent the other of the sides of the garage door opening.

An elongate rod 16 is rotatably mounted in the housing to permit free rotation about an axis of the rod. The rod is extended along the lower slot of the housing. Preferably, the rod has a pair of opposite ends rotatably mounted to the housing to rotatably mount the rod in the housing.

A generally rectangular flexible screen enclosure 17 has generally straight top and bottom edges and a pair of generally straight side edges extending between the top and bottom edges of the screen enclosure. The screen enclosure has a plurality of apertures of a predetermine size therethrough to prevent passage of objects therethrough greater than the predetermined size of the apertures. Ideally, the screen enclosure comprises a flexible mesh screen material. This permits a breezed to pass through the screen enclosure but blocks passage debris, such as blowing leaves, and of pests, such as insects and rodents, through the screen enclosure. The top edge of the screen enclosure is coupled to the rod so that the rest of the screen enclosure is downwardly depended from the rod through the lower slot of the housing. One of the sides edges of the screen enclosure is positioned adjacent one of the sides of the garage door opening. The other of the side edges of the screen enclosure is positioned adjacent the other of the sides of the garage door opening.

Figure 4:
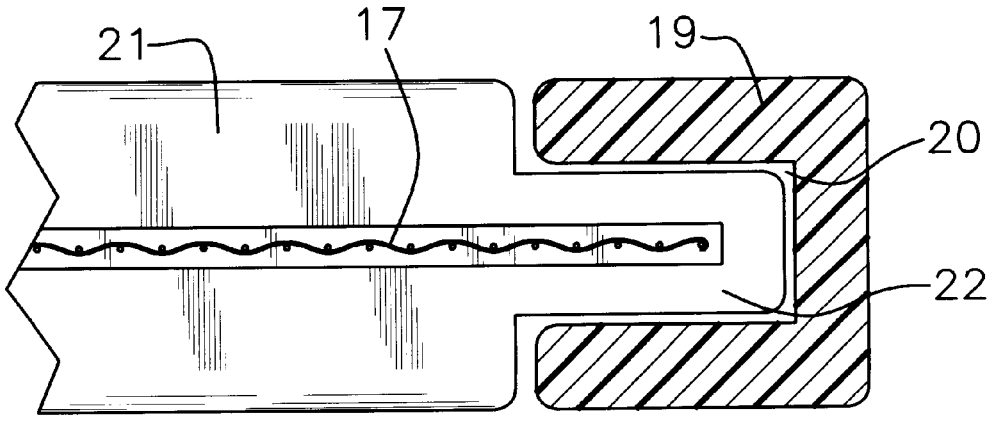
FIG. 4 is a schematic cross sectional view of a guide rail taken from line 4—4 of FIG. 1.

A pair of elongate guide rails 18,19 are coupled to the exterior of the garage structure. One of guide rails is positioned adjacent one of the sides of the garage door opening and the other guide rail is positioned adjacent the other side of the garage door opening. As illustrated in FIG. 1, the guide rails are extended substantially vertically along the associated side of the garage door opening between the top and bottom of the garage door opening. With reference to FIG. 4, each of the guide rails has an elongate guide channel 20 extending along the associated side of the garage door opening between the top and bottom of the garage door opening. The one side edge of the screen enclosure is slidably inserted into the guide channel of the one guide rail and the other side edge of the screen enclosure is slidably inserted into the guide channel of the other guide rail.

In use, the screen enclosure is positionable between an open position and a closed position. When in the closed position, the screen enclosure substantially covers the garage door opening. When in the open position, the garage door opening is substantially unblocked by the screen enclosure. In use, rotation of the rod in a first direction winds the screen enclosure about the rod to retract the screen enclosure into the housing to position the screen enclosure towards the open position. Conversely, rotation of the rod in a second direction unwinds the screen enclosure from about the rod to downwardly extend the screen enclosure from the housing towards the closed position. As the screen enclosure moved between the open and closed positioned, the side edges of the screen member slide along the elongate channels of the guide rails.

Preferably, an elongate bar 21 is coupled to the bottom edge of the screen member and extended between the side edges of the screen member. The bar has a pair of opposite ends. One of the ends of the bar is positioned adjacent one of the side edges of the screen enclosure and the other end of the bar is positioned adjacent the other of the side edges of the screen enclosure. As illustrated in FIG. 4, each of the ends of the bar has an extent 22 outwardly extending from the associated side edge of the screen enclosure.

Each of the extents of the bar is slidably inserted into the guide channel of the adjacent guide rail to permit sliding of the extents in their associated guide channel when the screen enclosure is moved between the open and closed positions. In use, the bar is positioned adjacent the bottom of the garage door opening when the screen is positioned in the closed position. When the screen enclosure is positioned in the open position, the bar is positioned adjacent the lower slot of the housing.

Ideally, a spaced apart pair of magnets 23 are coupled to the bar and a spaced apart pair of magnetizable metal plates 24 are coupled to the bottom of the garage door opening. The magnets are magnetically coupled to the magnetizable metal plates when the screen enclosure is positioned in the closed position to help hold the bottom edge of the screen enclosure to the bottom of the garage door opening against breezes that would otherwise blow open the screen enclosure.

Figure 5:
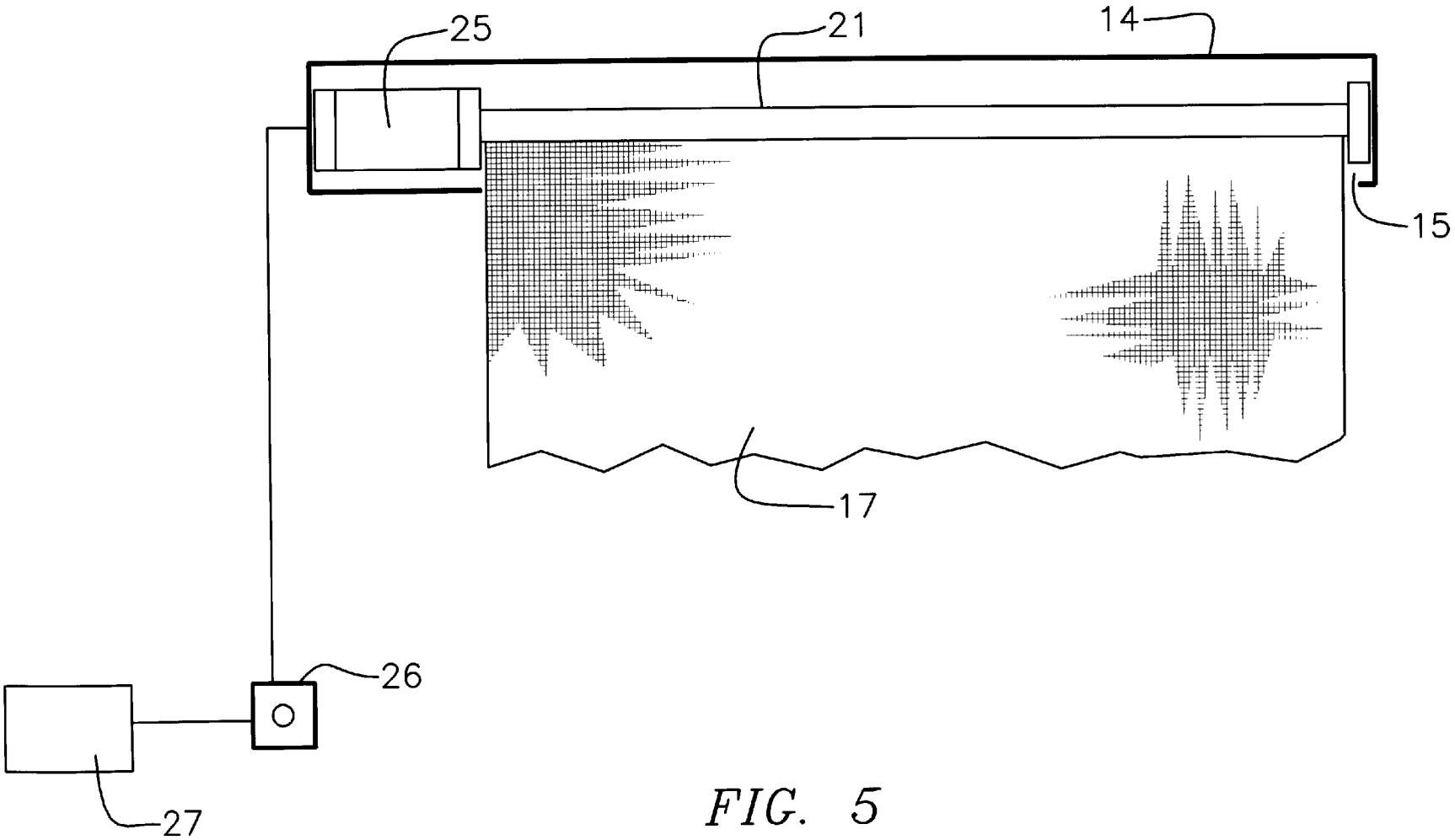
FIG. 5 is a schematic diagram of the components of the present invention for rotating the rod in the housing.

As illustrated in FIG. 5, a motor 25 is provided in the housing for rotating the rod about the axis of the rod in both the first and second directions. The motor is preferably located adjacent one of the ends of the lower slot. The motor is preferably coupled to one of the ends of the rod to rotate the rod about the axis of the rod. A controller 26 is electrically connected to the motor for selectively controlling the direction the motor rotates the rod. The controller is mounted to the garage structure. Optionally the controller may be a remote controller and be placed in a remote location, such as a user's vehicle, so that the user can open and close the screen enclosure while in their vehicle. The motor is electrically connected to an electrical power supply 27 to provide energy to the motor to rotate the rod.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination:

a garage structure having an interior, an exterior, and a generally rectangular garage door opening between said interior and said exterior of said garage structure;

said garage door opening of said garage structure having an outer perimeter comprising a top, a bottom, and a pair of sides extending between said top and bottom of said garage door opening;

a housing being coupled to said exterior of said garage structure and being positioned above said top of said garage door opening;

said housing having an elongate lower slot extending along said top of said garage door opening;

an elongate rod being rotatably mounted in said housing to permit free rotation about an axis of said rod, said rod being extended along said lower slot of said housing;

a flexible screen enclosure having top and bottom edges and a pair of side edges extending between said top and bottom edges of said screen enclosure;

said top edge of said screen enclosure being coupled to said rod, said screen enclosure being downwardly depended from said rod through said lower slot of said housing;

a pair of elongate guide rails being coupled to said exterior of said garage structure, one of guide rails being positioned adjacent one of said sides of said garage door opening, the other of said guide rails being positioned adjacent the other of said sides of said garage door opening, said guide rails being extended substantially vertically along the associated side of said garage door opening between said top and bottom of said garage door opening;

each of said guide rails having an elongate guide channel extending along the associated side of said garage door opening between said top and bottom of said garage door opening; and said one side edge of said screen enclosure being slidably inserted into said guide channel of said one guide rail, said other side edge of said screen enclosure being slidably inserted into said guide channel of said other guide rail;

an elongate bar being coupled to said bottom edge of said screen member, said bar being extended between said side edges of said screen member, said bar having a pair of opposite ends, one of said ends being positioned adjacent one of said side edges of said screen enclosure, the other of said ends of said bar being positioned adjacent the other of said side edges of said screen enclosure each of said ends of said bar having an extent outwardly extending from the associated side edge of said screen enclosure, each of said extents of said bar being slidably inserted into the guide channel of the adjacent guide rail to permit sliding of said extents in the associated guide channel;

a spaced apart pair of magnets coupled to said bar; and a spaced apart pair of magnetizable metal plates coupled to said bottom of said garage door opening in a recessed position such that a top surface of each of said magnetizable metal plates is coplanar with respect to an upper surface of said bottom of said garage door opening whereby said garage door opening is adapted for facilitating smooth ingress and egress from said interior of said garage structure to prevent tripping of a user traveling through said garage door opening, said magnets being substantially aligned with said magnetizable metal plates for magnetically coupling to said magnetizable metal plates for holding said screen enclosure in a static position.

2. The combination of claim 1, said screen enclosure is positionable between an open position and a closed position, wherein said screen enclosure substantially covers said garage door opening when positioned in said closed position, wherein said garage door opening is substantially unblocked by said screen enclosure when said screen enclosure is in said open portion.

3. The combination of claim 2, wherein rotation of said rod in a first direction winds said screen enclosure about said rod to retract said screen enclosure into said housing to position said screen enclosure towards said open position.

4. The combination of claim 3, wherein rotation of said rod in a second direction unwinds said screen enclosure from about said rod to downwardly extend said screen enclosure from said housing towards said closed position.

5. The combination of claim 1, further comprising a motor being provided in said housing for rotating said rod about said axis of said rod.

6. The combination of claim 5, further comprising a controller being electrically connected to said motor for selectively controlling the direction said motor rotates said rod.

7. The combination of claim 6, wherein said controller is mounted to said garage structure.

8. In combination:

a garage structure having an interior, an exterior, and a generally rectangular garage door opening between said interior and said exterior of said garage structure;

a garage door being mounted to said interior of said garage structure to retractably close said garage door opening;

said garage door opening of said garage structure having an outer perimeter comprising a generally horizontal top, a generally horizontal bottom, and a pair of generally vertical sides extending between said top and bottom of said garage door opening;

said top and bottom of said garage door opening being extended substantially parallel to one another, said sides of said garage door opening being extended substantially parallel to one another and substantially perpendicular to said top and bottom of said garage door opening;

a generally rectangular housing being coupled to said exterior of said garage structure and being positioned above said top of said garage door opening;

said housing having an elongate lower slot extending along said top of said garage door opening, said lower slot of said housing having a pair of opposite ends, one of said ends of said lower slot being positioned adjacent one of said sides of said garage, the other of said ends of said lower slot being positioned adjacent the other of said sides of said garage door opening;

an elongate rod being rotatably mounted in said housing to permit free rotation about an axis of said rod, said rod being extended along said lower slot of said housing;

wherein said rod has a pair of opposite ends rotatably mounted to said housing to rotatable mount said rod in said housing;

a generally rectangular flexible screen enclosure having generally straight top and bottom edges and a pair of generally straight side edges extending between said top and bottom edges of said screen enclosure;

said screen enclosure having a plurality of apertures of a predetermine size therethrough to prevent passage of objects therethrough greater than said predetermined size of said apertures whereby said screen enclosure is adapted for permitting a breeze to pass through the screen enclosure, wherein said screen enclosure comprises a flexible mesh screen material;

said top edge of said screen enclosure being coupled to said rod, said screen enclosure being downwardly depended from said rod through said lower slot of said housing;

one of said sides edges of said screen enclosure being positioned adjacent one of said sides of said garage door opening, the other of said side edges of said screen enclosure being positioned adjacent the other of said sides of said garage door opening;

a pair of elongate guide rails being coupled to said exterior of said garage structure, one of guide rails being positioned adjacent one of said sides of said garage door opening, the other of said guide rails being positioned adjacent the other of said sides of said garage door opening, said guide rails being extended substantially vertically along the associated side of said garage door opening between said top and bottom of said garage door opening;

each of said guide rails having an elongate guide channel extending along the associated side of said garage door opening between said top and bottom of said garage door opening;

said one side edge of said screen enclosure being slidably inserted into said guide channel of said one guide rail, said other side edge of said screen enclosure being slidably inserted into said guide channel of said other guide rail;

said screen enclosure being positionable between an open position and a closed position, wherein said screen enclosure substantially covers said garage door opening when positioned in said closed position, wherein said garage door opening is substantially unblocked by said screen enclosure when said screen enclosure is in said open portion;

wherein rotation of said rod in a first direction winds said screen enclosure about said rod to retract said screen enclosure into said housing to position said screen enclosure towards said open position;

wherein rotation of said rod in a second direction unwinds said screen enclosure from about said rod to downwardly extend said screen enclosure from said housing towards said closed position;

said side edges of said screen member sliding along said elongate channels of said guide rails as said screen enclosure moved between said open and closed positioned;

an elongate bar being coupled to said bottom edge of said screen member, said bar being extended between said side edges of said screen member;

said bar having a pair of opposite ends, one of said ends being positioned adjacent one of said side edges of said screen enclosure, the other of said ends of said bar being positioned adjacent the other of said side edges of said screen enclosure;

each of said ends of said bar having an extent outwardly extending from the associated side edge of said screen enclosure;

each of said extents of said bar being slidably inserted into the guide channel of the adjacent guide rail to permit sliding of sad extents in the associated guide channel when said screen enclosure is moved between said open and closed positions;

said bar being positioned adjacent said bottom of said garage door opening when said screen is positioned in said closed position;

said bar being positioned adjacent said lower slot of said housing when said screen enclosure is positioned in said open position;

a spaced apart pair of magnets being coupled to said bar;

a spaced apart pair of magnetizable metal plates aligned with said magnets, said magnetizable metal plates being coupled to said bottom of said garage door opening in a recessed position such that a top surface of each of said magnetizable metal plates is coplanar with respect to an upper surface of said bottom of said garage door opening whereby said garage door opening is adapted for facilitating smooth ingress and egress from said interior of said garage structure to prevent tripping of a user traveling through said garage door opening;

said magnets being magnetically coupled to said magnetizable metal plates when said screen enclosure is positioned in said closed position for facilitating holding of said screen enclosure to the bottom of the garage door opening such that the screen enclosure is adapted for preventing accidental opening of the screen enclosure by wind;

a motor being provided in said housing for rotating said rod about said axis of said rod in both said first and second directions, said motor being located adjacent one of said ends of said lower slot said motor being coupled to one of said ends of said rod to rotate said rod about said axis of said rod;

a controller being electrically connected to said motor for selectively controlling the direction said motor rotates said rod; and said controller being mounted to said garage structure.

* * * * *